US011913155B2

(12) United States Patent
Roetker et al.

(10) Patent No.: US 11,913,155 B2
(45) Date of Patent: Feb. 27, 2024

(54) METHOD OF CONTROLLING A FILTRATION SYSTEM IN A LAUNDRY TREATMENT APPLIANCE

(71) Applicant: Haier US Appliance Solutions, Inc., Wilmington, DE (US)

(72) Inventors: John Joseph Roetker, Louisville, KY (US); James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/526,142

(22) Filed: Nov. 15, 2021

(65) Prior Publication Data

US 2023/0151523 A1 May 18, 2023

(51) Int. Cl.

| | |
|---|---|
| ***D06F 33/32*** | (2020.01) |
| ***D06F 34/30*** | (2020.01) |
| ***D06F 34/32*** | (2020.01) |
| ***D06F 39/10*** | (2006.01) |
| ***D06F 39/08*** | (2006.01) |
| *D06F 101/20* | (2020.01) |
| *D06F 105/34* | (2020.01) |

(52) U.S. Cl.

CPC ..... *D06F 33/32* (2020.02); *D06F 34/30* (2020.02); *D06F 34/32* (2020.02); *D06F 39/085* (2013.01); *D06F 39/10* (2013.01); *D06F 2101/20* (2020.02); *D06F 2105/34* (2020.02)

(58) Field of Classification Search

CPC ..... D06F 33/30; D06F 33/32; D06F 33/36; D06F 33/38; D06F 33/42; D06F 34/22; D06F 34/28; D06F 34/30; D06F 34/32; D06F 39/083; D06F 39/085; D06F 39/10; D06F 2101/00; D06F 2101/02; D06F 2101/04; D06F 2101/06; D06F 2101/20; D06F 2105/34; D06F 2105/52; D06F 2105/54; D06F 2105/58

See application file for complete search history.

(56) References Cited

U.S. PATENT DOCUMENTS

| | | | | |
|---|---|---|---|---|
| 7,565,822 | B2 | 7/2009 | Park | |
| 7,797,969 | B2 | 9/2010 | Park | |
| 9,765,465 | B2 | 9/2017 | Im | |
| 2013/0290902 | A1* | 10/2013 | Martin | G06F 3/0485 715/830 |
| 2017/0284010 | A1* | 10/2017 | Zhang | D06F 39/006 |
| 2020/0199804 | A1 | 6/2020 | Magnusson | |
| 2020/0270795 | A1 | 8/2020 | Zarcone | |

* cited by examiner

*Primary Examiner* — David G Cormier

(74) *Attorney, Agent, or Firm* — Dority & Manning, P.A.

(57) ABSTRACT

A method of operating a laundry treatment includes receiving an input for a selected washing operation for a laundry load; determining a filtration requirement of the laundry load of the selected washing operation; implementing a responsive action in response to determining the filtration requirement of the laundry load, the responsive action including an activation state of a selector input on a user interface; and performing the selected washing operation according to a determined set of operating parameters.

10 Claims, 8 Drawing Sheets

METHOD OF CONTROLLING A FILTRATION SYSTEM IN A LAUNDRY TREATMENT APPLIANCE

FIELD OF THE INVENTION

The present subject matter relates generally to laundry appliances, and more particularly to methods for performing washing operations in a washing machine appliance.

BACKGROUND OF THE INVENTION

Laundry treatment appliances generally perform cleaning and/or drying operations on laundry loads, such as clothing, towels, linens, and the like. Some laundry treatment appliances, such as washing machines, may include a plurality of washing options available to users to provide ideal settings and parameters for specific laundry loads. Users may select a particular option which incorporates preset options depending on the type of laundry load being washed. For instance, some laundry loads require hot water, high spin speed, long spin times, extra draining, and the like.

Some laundry treatment appliances incorporate one or more filters, for instance, for filtering out particles from the wash water used in washing the laundry load. Some laundry loads require more robust or thorough filtration than other laundry loads, leading to adjustments to operating parameters. As one example, synthetic fibers may produce harmful waste during a washing cycle which may in turn be drained to aquatic environments, contributing to dangerous pollution. Conversely, some laundry loads benefit from forgoing filtration, such as heavy lint-producing loads or certain unsanitary loads. Unnecessary filtering may lead to increased filter changes, which may be undesirable to users. However, existing appliances exhibit deficiencies in properly applying filtering to washing operations.

Accordingly, a laundry treatment appliance that obviates one or more of the above-mentioned drawbacks would be beneficial. Particularly, a method for operating a laundry treatment appliance to selectively apply a filter operation would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a laundry treatment appliance is provided. The laundry treatment appliance may include a tub, a wash basket rotatably provided within the tub, a user interface, and a filter fluidly connected with the tub. The method may include receiving an input for a selected washing operation for a laundry load; determining a filtration requirement of the laundry load of the selected washing operation; changing an activation state of a selector input on the user interface in accordance with the determined filtration requirement; and performing the selected washing operation according to a determined set of operating parameters.

In another exemplary aspect of the present disclosure, a laundry treatment appliance is provided. The laundry treatment appliance may define a vertical direction, a lateral direction, and a transverse direction. The laundry treatment appliance may include a cabinet forming a receiving space; a user interface provided on the cabinet, the user interface including a selector input; a tub provided within the receiving space; a wash basket rotatably provided within the tub and configured to hold a laundry load and a wash fluid; a filter in fluid communication with the tub, the filter selectively filtering the wash fluid; a first drain line fluidly connected with the tub; a second drain line fluidly connected with the tub, the second drain line being in fluid parallel with the first drain line; and a controller provided within the cabinet and configured to perform a series of operations. The series of operations may include receiving an input for a selected washing operation for the laundry load; determining a filtration requirement of the laundry load of the selected washing operation; changing an activation state of the selector input in accordance with the determined filtration requirement; and performing the selected washing operation according to a determined set of operating parameters.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
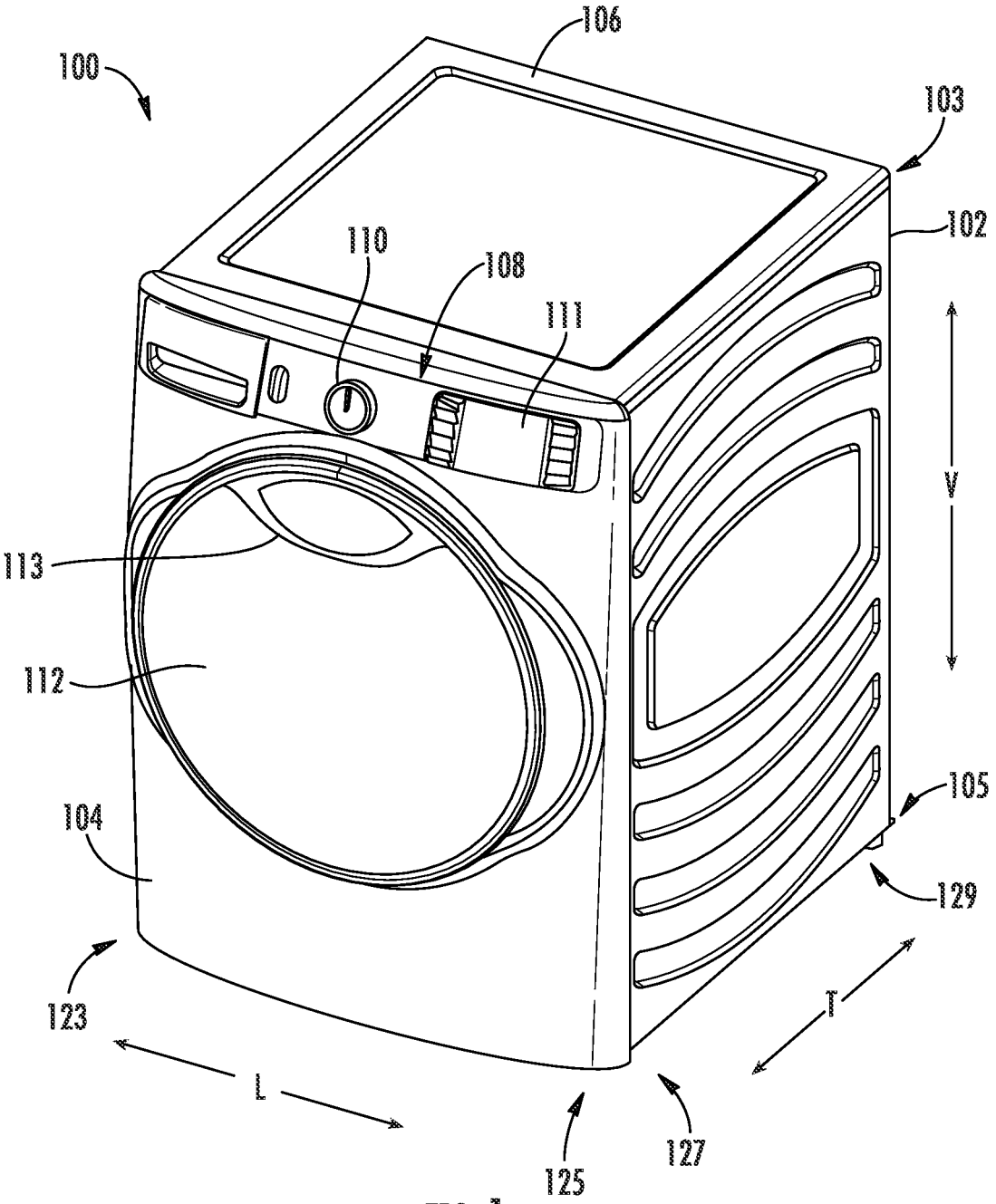
FIG. 1 provides a front, perspective view of a laundry treatment appliance according to an exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
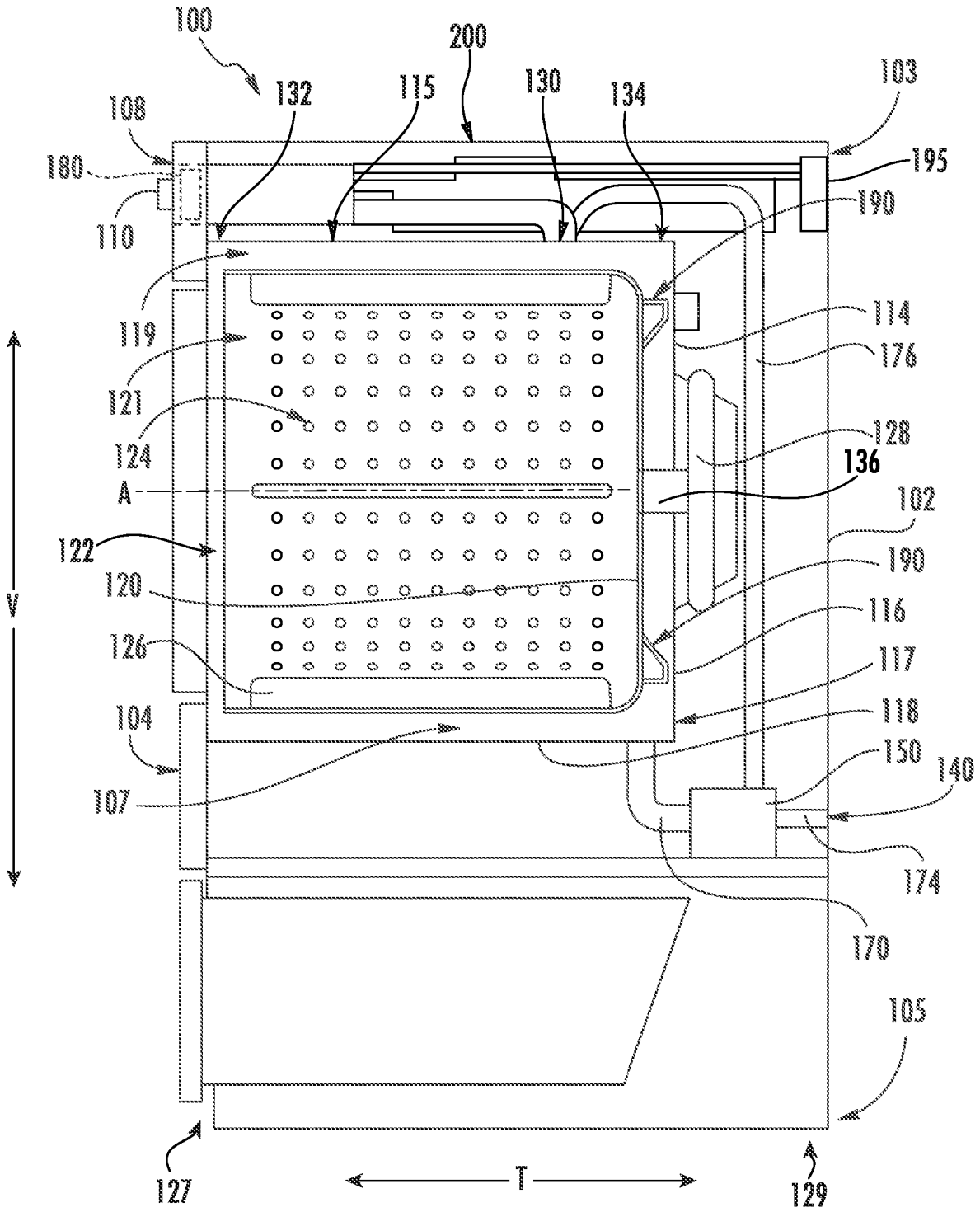
FIG. 2 provides a side, cross-sectional view of the exemplary laundry treatment appliance of FIG. 1.

FIGS. 1 and 2 provide various views of an exemplary laundry treatment apparatus 100 according to one exemplary embodiment of the present disclosure. In particular, FIG. 1 provides a front, perspective view of horizontal axis laundry treatment apparatus 100 and FIG. 2 provides a side, section view of laundry treatment apparatus 100. As shown in FIG. 1, laundry treatment apparatus 100 includes a cabinet 102 that extends between a top 103 and a bottom 105, e.g., along a vertical direction V. Cabinet 102 also extends between a first side 123 and a second side 125, e.g., along a lateral direction L, and between a front 127 and a rear 129, e.g., along a transverse direction T. The vertical, lateral, and transverse directions V, L, T defined by laundry treatment apparatus 100 are mutually perpendicular and together define an orthogonal direction system. Cabinet 102 may form a receiving space.

Cabinet 102 includes a front panel 104. A door 112 may be mounted to front panel 104 and may be rotatable between an open position (not shown) facilitating access to a wash drum or basket 120 (FIG. 2) located within cabinet 102, and a closed position (shown in FIGS. 1 and 2) hindering access to basket 120. A user may pull on a handle 113 in order to selectively adjust door 112 between the open and closed positions. Cabinet 102 also includes a top panel 106 positioned at top 103 of cabinet 102.

A control panel 108 including a plurality of input selectors 110 may be coupled to front panel 104. Control panel 108 and input selectors 110 collectively form a user interface input for operator selection of machine cycles and features. For example, in some embodiments, control panel 108 includes a display 111 (FIG. 1) configured to present or indicate selected features, a countdown timer, and/or other items of interest to machine users.

As shown in FIG. 2, a tub 114 defines a wash fluid compartment 119 configured for receipt of a washing fluid. Thus, tub 114 is configured for containing washing fluid, e.g., during operation of laundry treatment apparatus 100. Washing fluid disposed within tub 114 may include, for example, at least one of water, fabric softener, bleach, and detergent. Tub 114 includes a back wall 116 and a sidewall 118 and extends between a top 115 and a bottom 117, e.g., along the vertical direction V. Further, tub 114 extends between a front 132 and a rear 134, e.g., along the transverse direction T.

Basket 120 is rotatably mounted within tub 114 in a spaced apart relationship from tub sidewall 118 and tub back wall 116. One or more bearing assemblies may be placed between basket 120 and tub 114 and may allow for rotational movement of basket 120 relative to tub 114. Basket 120 defines a wash chamber 121 and an opening 122. Opening 122 of basket 120 permits access to wash chamber 121 of basket 120, e.g., in order to load articles into basket 120 and remove articles from basket 120. Basket 120 also defines a plurality of perforations 124 to facilitate fluid communication between an interior of basket 120 and tub 114. A sump 107 is defined by tub 114 and is configured for receipt of washing fluid during operation of appliance 100. For example, during operation of appliance 100, washing fluid may be urged by gravity from basket 120 to sump 107 through plurality of perforations 124.

A spout 130 is configured for directing a flow of fluid into tub 114. Spout 130 may be in fluid communication with a water supply (not shown) in order to direct fluid (e.g., clean water) into tub 114. A pump assembly 150 (shown schematically in FIG. 2) is located beneath tub 114 for draining tub 114 of fluid. Pump assembly 150 is in fluid communication with sump 107 of tub 114 via a conduit 170. Thus, conduit 170 directs fluid from tub 114 to pump assembly 150. Pump assembly 150 is also in fluid communication with a drain 140 via piping 174. Pump assembly 150 can urge fluid disposed in sump 107 to drain 140 during operation of appliance 100 in order to remove fluid from tub 114. Fluid received by drain 140 from pump assembly 150 is directed out of appliance 100, e.g., to a sewer or septic system.

In addition, pump assembly 150 is configured for recirculating washing fluid within tub 114. Thus, pump assembly 150 is configured for urging fluid from sump 107, e.g., to spout 130. For example, pump assembly 150 may urge washing fluid in sump 107 to spout 130 via hose 176 during operation of appliance 100 in order to assist in cleaning articles disposed in basket 120. It should be understood that conduit 170, piping 174, and hose 176 may be constructed of any suitable mechanism for directing fluid, e.g., a pipe, duct, conduit, hose, or tube, and are not limited to any particular type of mechanism.

A motor 128 is in mechanical communication with basket 120 in order to selectively rotate basket 120, e.g., during an agitation or a rinse cycle of laundry treatment apparatus 100 as described below. In particular, a shaft 136 mechanically couples motor 128 with basket 120 and drivingly rotates basket 120 about a shaft or central axis A, e.g., during a spin cycle. Ribs 126 may extend from basket 120 into wash chamber 121. Ribs 126 may assist agitation of articles disposed within wash chamber 121 during operation of laundry treatment apparatus 100. For example, ribs 126 may lift articles disposed in basket 120 during rotation of basket 120.

Also shown in FIG. 2 is a balancing apparatus 190. Balancing apparatus 190 can include a balancing ring, for example. The balancing ring can have an annular cavity in which a balancing material is free to rotate and move about. For example, the balancing material can be a fluid such as water or can be balancing balls. The balancing ring can include one or more interior baffles. Although a single balancing ring or apparatus 190 is shown in FIG. 2, any number of such rings or apparatuses can be included in laundry treatment apparatus 100 and can be placed according to any known or desirable configuration. For example, two balancing rings can be respectively placed at the front and back of basket 120.

As further shown in FIG. 2, laundry treatment apparatus 100 includes a detergent dispenser 200. Detergent dispenser 200 may include features for receiving various wash treatment additives (e.g., fluid detergent, powder detergent, fabric softener, bleach, powder or any other suitable liquid) and dispensing or directing them to wash fluid compartment 119 of tub 114 during operation of laundry treatment apparatus 100. Detergent dispenser 200 will be described in further detail herein.

Operation of laundry treatment apparatus 100 is controlled by a processing device or controller 180 that is operatively coupled to control panel 108 for user manipulation to select washing cycles and features. In response to user manipulation of control panel 108, controller 180 operates the various components of laundry treatment apparatus 100 to execute selected machine cycles and features, which will be described in further detail herein.

Controller 180 may include a memory and microprocessor, such as a general or special purpose microprocessor operable to execute programming instructions or microcontrol code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 180 may be constructed without using a microprocessor, e.g., using a combination of discrete analog and/or digital logic circuitry (such as switches, amplifiers, integrators, comparators, flip-flops, gates, and the like) to perform control functionality instead of relying upon software. Control panel 108 and other components of laundry treatment apparatus 100 may be in communication with controller 180 via one or more signal lines or shared communication busses.

In an illustrative example of operation of laundry treatment apparatus 100, laundry items are loaded into basket 120, and a washing operation is initiated through operator manipulation of input selectors 110. Tub 114 may be filled with water and one or more wash treatment additives from detergent dispenser 200 to form a wash fluid. One or more valves of a water inlet valve 195 can be actuated by controller 180 to provide for filling tub 114 to the appropriate level for the amount (or number) of articles being washed. Water inlet valve 195 is in fluid communication with a water source, such as e.g., a hot water heater and/or a municipal water line. Once tub 114 is properly filled with wash fluid, the contents of basket 120 may be agitated with ribs 126 for cleansing of laundry items in basket 120.

After the agitation phase (e.g., first agitation phase, second agitation phase, etc.) of the wash cycle is completed, tub 114 may be drained. Laundry articles may then be rinsed by again adding wash fluid to tub 114 depending on the particulars of the cleaning cycle selected by a user, and ribs 126 may again provide agitation within wash chamber 121. One or more spin cycles may also be used. In particular, a spin cycle may be applied after the wash cycle and/or after the rinse cycle in order to wring wash fluid from the articles being washed. During the spin cycle, basket 120 is rotated at relatively high speeds.

While described in the context of a specific embodiment of horizontal axis laundry treatment apparatus 100, it will be understood that horizontal axis laundry treatment apparatus 100 is provided by way of example only. Other laundry treatment apparatuses having different configurations, different appearances, and/or different features may also be utilized with the present subject matter as well, including, for example, vertical axis laundry treatment apparatuses. Thus, the teachings of the present disclosure are not limited to use with laundry treatment apparatus 100.

Figure 3:
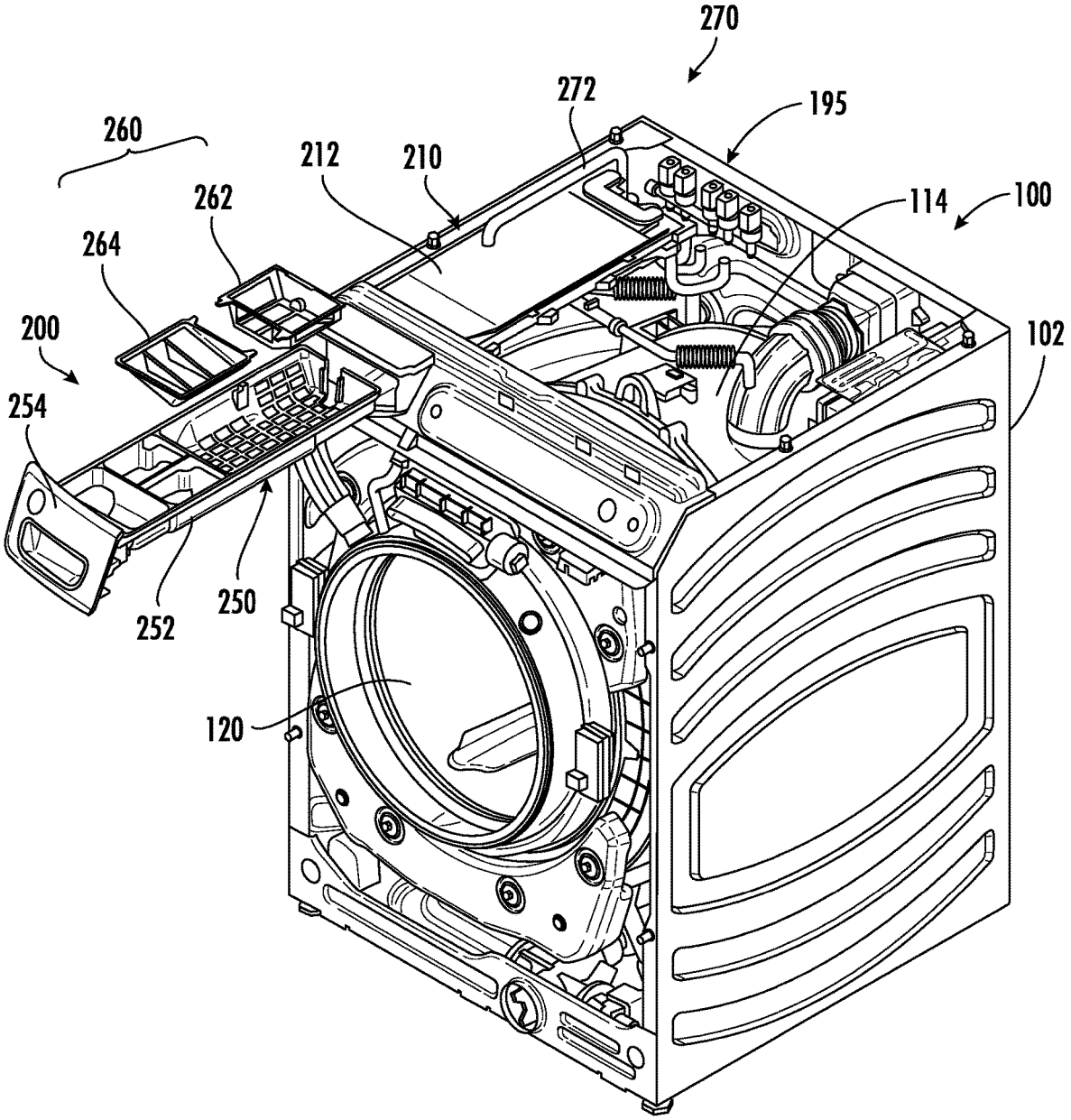
FIG. 3 provides a partial exploded perspective view of the dispensing assembly of the laundry treatment appliance of FIG. 1.
Figure 4:
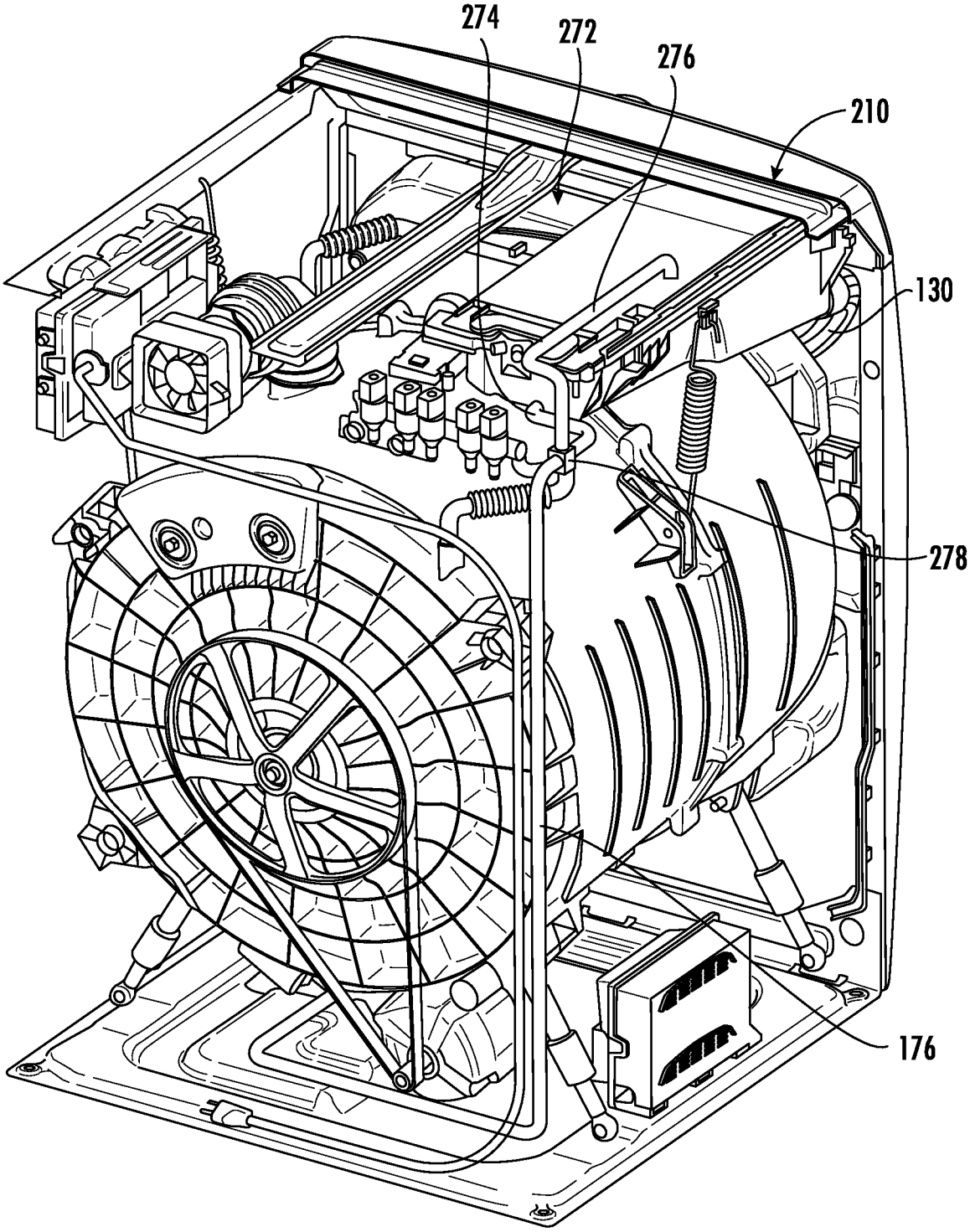
FIG. 4 provides a rear perspective view of the laundry treatment appliance of FIG. 1 showing an interior of the cabinet.

FIG. 3 provides a view of a detergent dispenser 200 of the laundry treatment apparatus of FIGS. 1 and 2 according to an exemplary embodiment of the present disclosure. More specifically, FIG. 3 provides a partial exploded perspective view of detergent dispenser 200. As shown in FIG. 3, detergent dispenser 200 may include a diffuser assembly 210 and drawer assembly 250. Diffuser assembly 210 may have a manifold 212 that has a generally rectangular shape. Manifold 212 may extend between a front and a back, e.g., along the transverse direction T, between a top and a bottom, e.g., along the vertical direction V, and between a first side and a second side, e.g., along the lateral direction L.

Further, manifold 212 may define an interior volume. The interior volume of manifold 212 may be sized to receive at least portion of drawer assembly 250. Drawer assembly 250 may be slidably received within manifold 212 (i.e., within the interior volume of manifold 212) between a withdrawn position and a retracted position. That is, drawer assembly 250 may be movable between the withdrawn position and the retracted position, e.g., along the transverse direction T. In the withdrawn position, drawer assembly 250 may be at least partially withdrawn from manifold 212 so that a user may readily access one or more additive compartments of drawer assembly 250, e.g., to fill one of the compartments with an additive. In the retracted position, drawer assembly 250 may be received within manifold 212, e.g., so that one or more of the additive compartments of drawer assembly 250 are in fluid communication with water inlet valve 195 and tub 114 during operation of laundry treatment apparatus 100. Generally, drawer assembly 250 may include a drawer 252 and a handle 254. A user may grasp handle 254 of drawer assembly 250 to slide or move drawer assembly 250 between the withdrawn and retracted positions. An opening defined by front panel 104 may allow drawer assembly 250 to slide or move between the withdrawn and retracted positions.

Laundry treatment appliance 100 may include a filter 260. In detail, filter 260 may be in fluid communication with hose 176. Wash fluid from wash tub 114 may pass through filter 260 via hose 176. For instance, during a selected washing operation, wash fluid may be periodically cycled from wash tub 114 via hose 176 through filter 260. The filtered wash fluid may then be supplied back to wash tub 114 (e.g., with supplemental wash water and/or detergent). Thus, during the washing operation, the wash fluid is filtered to remove contaminants therefrom.

In at least some embodiments, as shown in FIG. 3, filter 260 is provided within drawer 252. Accordingly, when the wash fluid is circulated through hose 176 and supplied to drawer 252, the wash fluid may be filtered through filter 260. In some embodiments, filter 260 is provided as a gravity filter or an open filter. Thus, the wash fluid supplied via hose 176 may simply fall onto or into filter 260 and seep through due to gravity toward a bottom of drawer 252. According to another embodiment, filter 260 is a closed filter. Accordingly, the wash fluid may be supplied to filter 260 in a pressurized state. It should be understood that filter 260 may be any suitable filter.

Filter 260 may include a fine filter 262 and a coarse filter 264. In detail, fine filter 262 may be configured to provide filtration for small particles (e.g., between about 1 micron and about 50 micron). The wash fluid may be selectively supplied to fine filter 262, e.g., according to selected washing operations. For instance, in particular washing operations that produce particles under a certain limit, controller 180 may instruct laundry treatment appliance 100 to circulate the wash fluid through fine filter 262. The process of supplying the wash fluid to filter 260 (e.g., fine filter 262) may be performed repeatedly throughout the selected washing operation.

Coarse filter 264 may be located adjacent to fine filter 262. For instance, coarse filter 264 may be located in front of fine filter 262 (e.g., along the transverse direction T near handle 254). In some embodiments, fine filter 262 and coarse filter 264 are provided as a single filter piece 260). Coarse filter 264 may be configured to provide filtration for relatively large particles (e.g., between about 50 micron and about 200 micron). Accordingly, fine filter 262 may filter relatively smaller particles as compared to those filtered by coarse filter 264. The wash fluid may be selectively supplied to fine filter 262, e.g., according to selected washing operations. For instance, in particular washing operations that typically produce large contaminant particles (e.g., lint), controller 180 may instruct laundry treatment appliance 100 to circulate the wash fluid through coarse filter 264. In some embodiments, the wash water is supplied first to coarse filter 264 and subsequently to fine filter 262. Accordingly, fine filter 262 may not be overwhelmed or clogged with relatively large particles.

As described briefly above, the wash fluid may be circulated (or recirculated) through the tub (e.g., via hose 176 and pump assembly 150). For instance, laundry treatment appliance 100 may include a fluid recirculation system 270 through which the wash fluid from tub 114 is recirculated to tub 114 (e.g., after having passed through filter 260). Fluid recirculation system 270 may include pump assembly 150 and hose 176, as well as dispenser drawer 252. Accordingly, the wash fluid may be drained from tub 114 into hose 176 (e.g., a recirculation hose), pumped through hose 176 via pump assembly 150 through filter 260 provided within drawer 252. Filter 260 may remove particles, contaminants, foreign bodies, or the like before resupplying the wash fluid to tub 114 (e.g., via spout 130). As shown in FIG. 3, spout 130 may be provided at or near a front of tub 114 (e.g., near front panel 104). It should be noted that the specific location of spout 330 is not limited to the examples described herein.

Hose 176 may include a supply section 272. For instance, the wash fluid may be supplied to drawer 252 (and subsequently filter 260) via supply section 272. Supply section 272 may include a fine supply section 274 and a coarse supply section 276. In detail, a diverter valve (or any type of switching valve) 278 may be provided on hose 176 to divert the wash fluid to one of fine supply section 274 or coarse supply section 276. Diverter valve 278 may receive signals from controller 180 during a washing operation to supply the wash fluid to the proper supply section. Accordingly, the wash fluid may be easily supplied to the correct filter (e.g., fine 262 or coarse 264).

Figure 5:
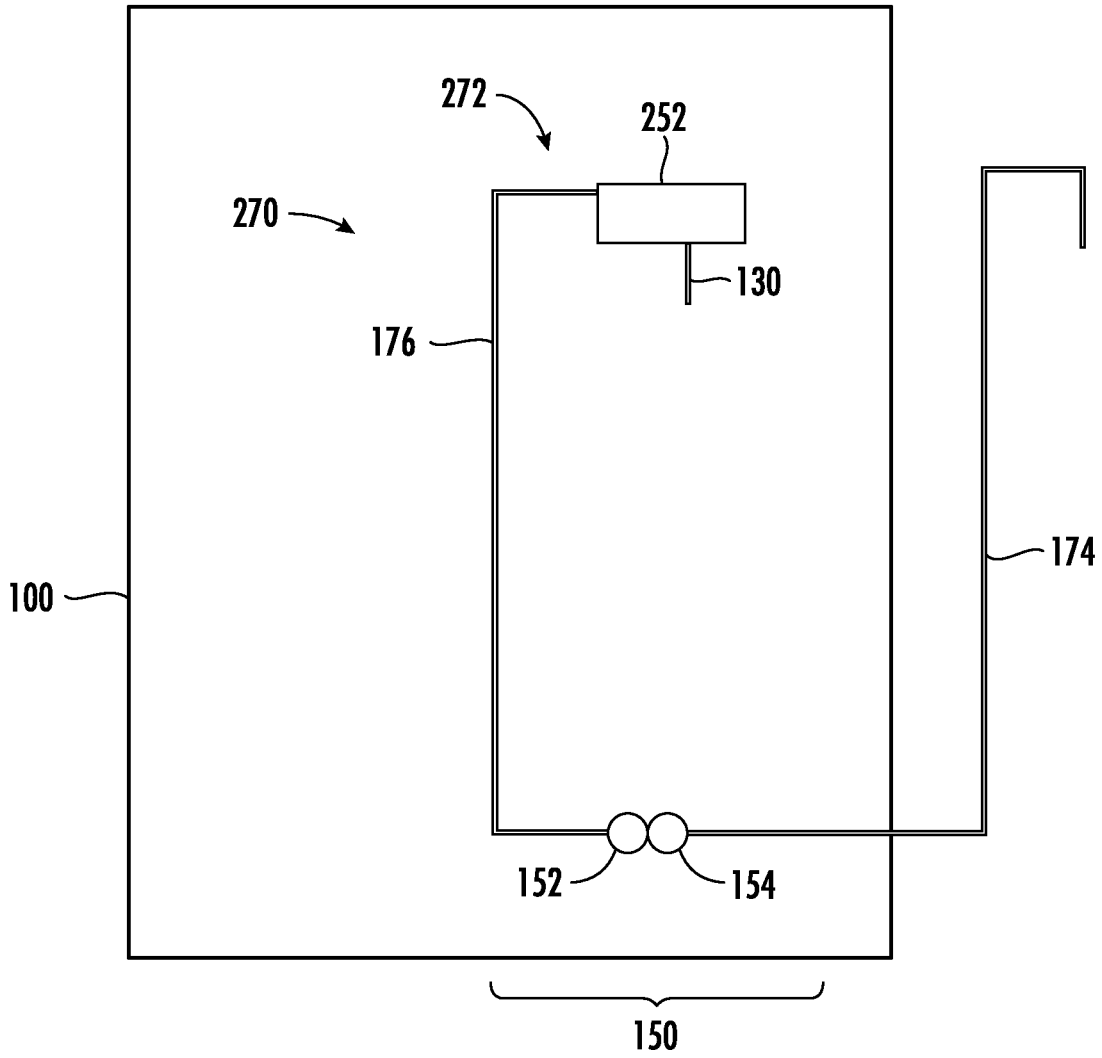
FIG. 5 provides a schematic view of an embodiment of a circulation system of a laundry treatment appliance.
Figure 6:
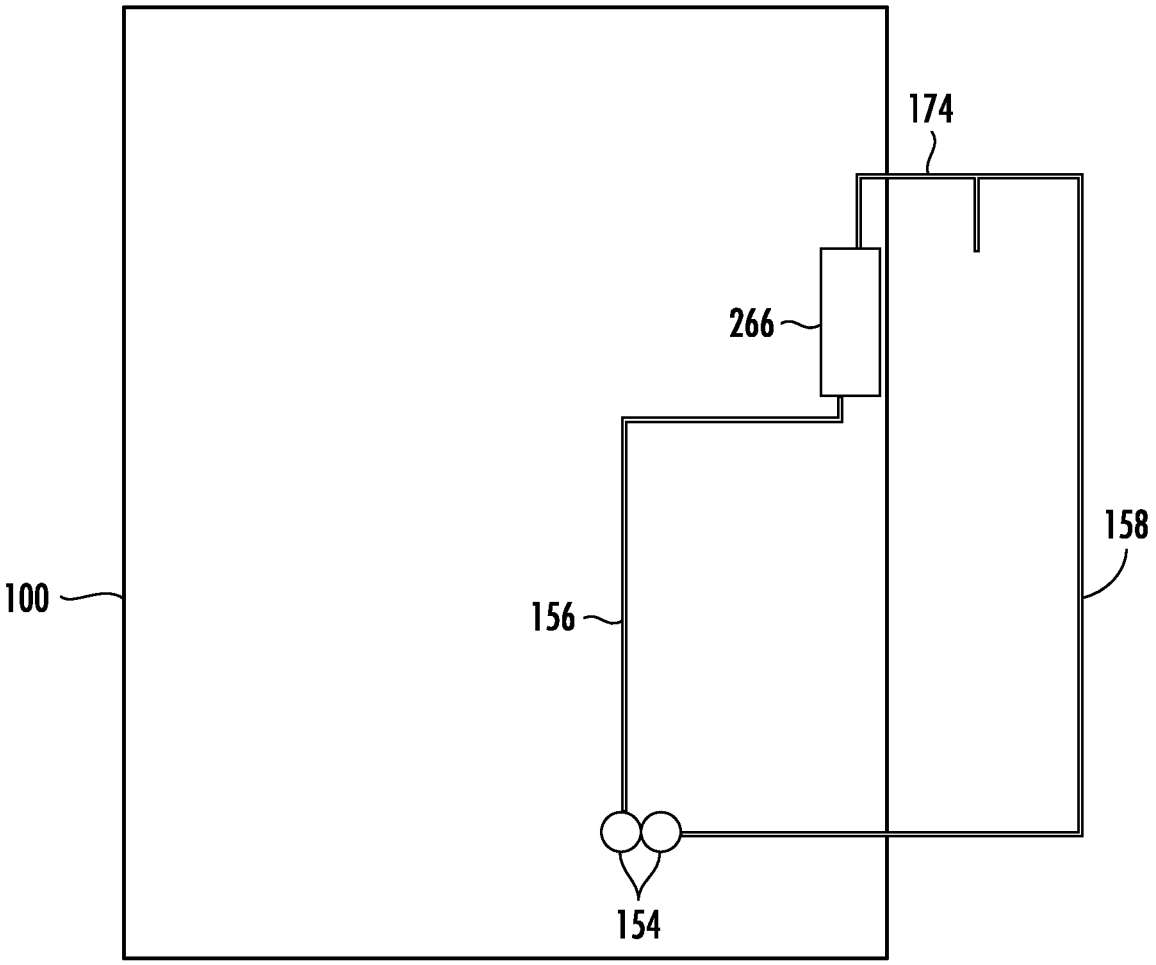
FIG. 6 provides a schematic view of another embodiment of a circulation system of a laundry treatment appliance.

FIG. 5 provides a schematic view of one embodiment of the present disclosure featuring a recirculating filter, and FIG. 6 provides a schematic view of another embodiment of the present disclosure featuring a drain filter. The embodiment provided in FIG. 6 includes two drain lines, which will be explained in detail below. Moreover, each of the embodiment in FIG. 5 and the embodiment in FIG. 6 may incorporate two pumps (e.g., a drain pump and a circulation pump, two drain pumps, etc.). It should be noted that the disclosure is not limited to these examples, and certain embodiments may incorporate one or more of the following features.

Referring now briefly to FIG. 5, laundry treatment appliance 100 may include pump assembly 150. According to this embodiment, pump assembly 150 includes recirculation pump 152 and drain pump 154. Recirculation pump 152 may selectively pump the wash fluid (e.g., from sump 107) through a recirculation hose (e.g., hose 176) to filter 260 (e.g., within drawer 252). As described above, the wash fluid may be supplied to fine filter 262 or coarse filter 264 via fine supply section 274 or coarse supply section 276. The wash fluid may then be filtered through filter 260 and resupplied to tub 114 via spout 330. In some instances, this may be referred to as an internal recirculation filter arrangement or assembly.

Drain pump 154 may selectively pump the wash fluid (e.g., from sump 107) out of cabinet 102. For instance, drain piping 174 may be fluidly connected with drain pump 174. According to this embodiment, the wash fluid is selectively drained from laundry treatment appliance 100 without passing through filter 260. In some embodiments, an optional additional filter is provided along piping 174. Advantageously, certain washing loads that do not require filtration or which may produce excess material capable of clogging a filtration system may be drained without passing through filter 260, thus increasing a lifespan of filter 260 and reducing the possibility of damage to appliance 100.

Referring now to FIG. 6, laundry treatment appliance 100 may include pump assembly 150. Pump assembly 150 may include drain pump 154. In some instances, pump assembly includes two separate drain pumps 154, each with a dedicated drain line. In detail, a first drain pump 154 may selectively pump the wash fluid (e.g., from sump 107) through a first drain line 156. First drain line may be hose 176. Additionally or alternatively, first drain line 156 may be a separate hose similar to hose 176. First drain line 156 may be fluidly connected with filter 260. For instance, first drain line 156 may allow the wash fluid from flow from sump 107 (via first drain pump 154) into a filter housing 266, the filter housing 266 having filter 260 provided therein. Filter housing may be provided within cabinet 102 of appliance 100.

Filter housing 266 may be separate from drawer 252. In detail, filter housing 266 may not be in fluid communication with tub 114. Accordingly, the wash fluid supplied to filter housing 266 may not be resupplied to tub 114. At the conclusion of the selected washing operation, the wash fluid may be motivated through first drain line 156 into filter housing 266. Filter 260 (e.g., fine filter 262 and/or coarse filter 264) may then filter out foreign substances. From filter housing 266, the wash fluid may be expelled from cabinet 102 (e.g., via a drain line such as piping 174).

Second drain pump 154 may have a second drain line 158 fluidly attached thereto. Second drain pump 154 may selectively pump the wash fluid (e.g., from sump 107) through second drain line 158. Second drain line 158 may not be in fluid communication with filter housing 266. In detail, second drain line 158 may pass directly out of cabinet 102 of appliance 100 without passing through filter housing 266. Accordingly, the wash fluid pumped through second drain line 158 does not pass through filter 260 and thus is not filtered before being drained from appliance 100. Controller 180 may selectively operate one of the first or second drain pump 154 according to a selected washing operation, which will be explained below. In some embodiments, a single drain pump 154 is provided. According to these embodiments, a switching valve (not shown) may be provided on a primary drain line. The switching valve may selectively direct the draining wash fluid to one of first drain line 156 or second drain line 158.

Figure 7:
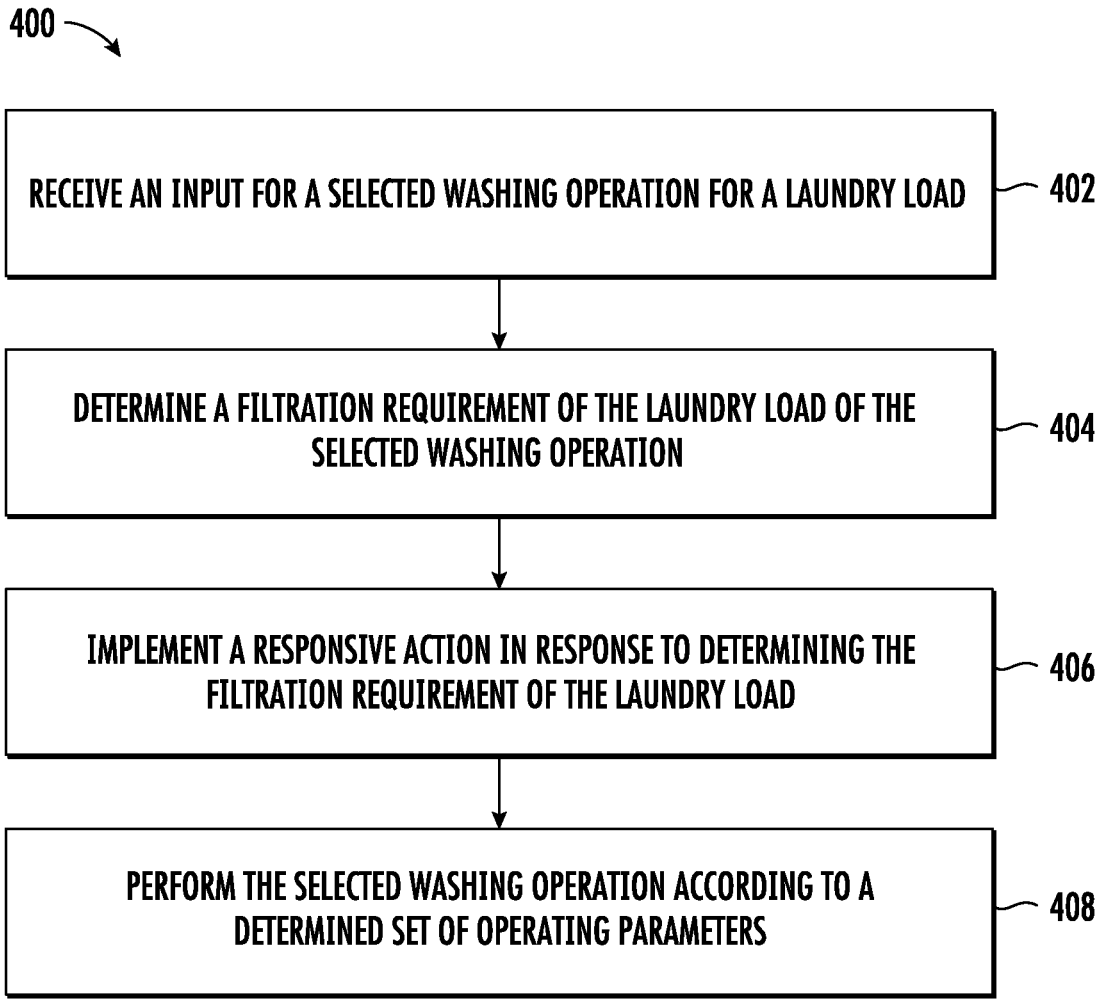
FIG. 7 provides a flow chart illustrating a method of operating a laundry treatment appliance according to exemplary embodiments of the present disclosure.
Figure 8:
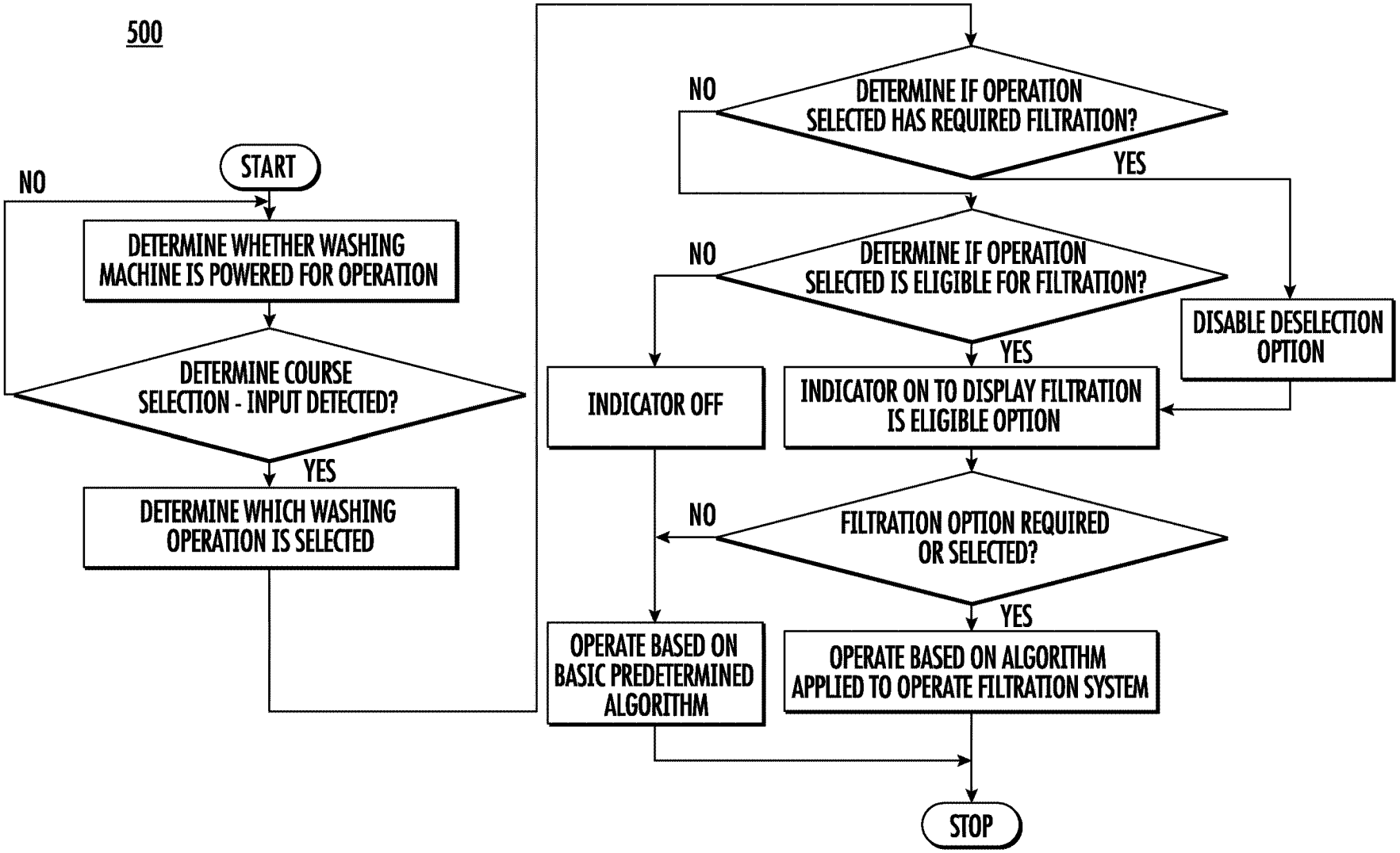
FIG. 8 provides a flow chart illustrating a control method of operating a laundry treatment appliance according to exemplary embodiments of the present disclosure.

Now that the general descriptions of an exemplary appliance has been described in detail, a method 400 of operating an appliance (e.g., laundry treatment appliance 100) will be described in detail. Although the discussion below refers to the exemplary method 400 of operating laundry treatment appliance 100, one skilled in the art will appreciate that the exemplary method 400 is applicable to any suitable domestic appliance capable of performing a washing operation (e.g., such as a combination washing machine/dryer, a stand-alone washer, etc.). In exemplary embodiments, the various method steps as disclosed herein may be performed by controller 180 and/or a separate, dedicated controller. FIGS. 7 and 8 provide flow charts illustrating methods of operating a laundry treatment appliance. Hereinafter, method 400 will be described with specific reference to FIG. 7.

With reference now to FIG. 7, at step 402, method 400 may include receiving an input for a selected washing operation for a laundry load. In detail, a controller (e.g., controller 180) of a laundry treatment appliance (e.g., appliance 100) may receive an input via a user interface (e.g., control panel 108) on the appliance. In some embodiments, the input is received remotely, such as from a connected device (e.g., mobile phone). A user may select a washing operation via an input selector (e.g., input selector 110), such as a rotary dial, for example. The input selector may allow the user to select a particular washing operation from a plurality of washing operations. For example, the plurality of washing operations include normal, whites, towels, bulky, sanitize, power clean, quick wash, delicates, cold wash, synthetics, rinse and spin, and self clean. It should be understood the examples given herein are not exhaustive, and that the plurality of washing operations may include additional potential operations.

At step 404, method 400 may include determining a filtration requirement of the laundry load of the selected washing operation. In detail, the controller may determine whether or not a filtration operation or cycle is deemed to be required for the selected washing operation. A table may be stored onboard the appliance including a list of washing operations that require filtration, from which the controller may obtain the required information to determine the filtration requirements. In at least one example, the synthetics washing operation may require a filtration (e.g., before draining the washing fluid from the wash tub).

For instance, the controller may determine that filtration is required (e.g., for the synthetics washing operation). As described above, the filtration of the laundry load (or the filtration of the wash fluid used to wash the laundry load) may be performed in the midst of the washing operation or during a draining operation. In some embodiments, the controller may further determine whether the filtration requirement calls for multiple filtration cycles or a single filtration cycle. Moreover, the controller may determine whether a required filtration should be performed during the washing operation or during the draining cycle. Depending on the construction of the appliance, only one option may be accessible.

At step 406, method 400 may include changing an activation state of a selector input on the user interface in accordance with the determined filtration requirement. In detail, the user interface (or control panel) may include an option to select whether or not to perform a filtration of the laundry load or wash fluid. For instance, the option may be a button, such as a touch button, a push button, a toggle switch, or the like. In order to select whether to have the appliance perform a filter cycle or not perform a filter cycle, the user may push, switch, toggle, or otherwise manipulate the input.

As at least one example, the input is a touch button. The touch button may be located prominently on the user interface of the appliance. As would be understood, the touch button may be a capacitive touch button, a pressure touch button, a proximity touch button, or the like. Thus, a user may contact the touch button to indicate a desire for a filtration of the wash fluid. In at least one example, the touch button is presented as a "filtration on" button. Additionally or alternatively, a separate touch button may be provided on the user interface. The separate touch button may be presented as a "filtration off" button. In at least some embodiments, a single touch button is presented with the capability to toggle between an "on" and an "off" setting for filtration. A light emitting diode (LED) may accompany the touch button. For instance, the touch button may be backlit by the LED so as to identify the button to the user. Accordingly, changing the activation state of the selector input may include one or more of enabling or disabling the touch sensitivity of the button and activating or deactivating the LED.

Continuing from the above example, upon receiving the input for the washing operation, the controller may determine that a filtration is required (e.g., for the synthetics operation). Accordingly, the controller may determine that the user is unable to select the option to forego or not perform the filtration option. The controller may thus deactivate the selector input (e.g., the touch button). The deactivation may take place at the button itself or within the controller. In detail, the controller may restrict any input (e.g., electrical, etc.) from being recognized. Additionally or alternatively, the controller may simply ignore any input received from the button. Moreover, the controller may deactivate the LED provided at the touch button. Thus, the LED is not illuminated, further indicating to the user that they are unable to deselect the filtration option.

According to another example, the controller may determine that the selected washing operation does not require filtration. Accordingly, the controller may activate the button (e.g., the touch button) associated with the filtration option. The button may be activated such that the user may press the button to select the option to perform the filtration. Additionally or alternatively, the controller may activate the LED to illuminate the button. According to this example, the washing load is one for which filtration is optional but not required. Filtration optional or eligible washing operations may include normal, whites, towels, bulky, sanitize, delicates, cold wash, and self clean, for example. Thus, before initiating the washing operation, the user may optionally select whether to have the appliance perform the filtration cycle. Again, as described above, the filtration may occur during the washing operation or during the draining cycle.

According to still another embodiment, the controller may determine that the selected washing load is ineligible for filtration. In detail, some washing loads may be restricted from having a filtration cycle performed for various reasons. Some loads may regularly produce a large amount of potentially clogging by-products (such as excessive lint), some loads may be biohazardly dangerous to filter, some loads may be deteriorated by a filtration cycle, some loads may simply not require filtration due to not producing contaminants, or the like. For example, filtration ineligible washing operations may include power clean, quick wash, and rinse and spin. Accordingly, the controller may deactivate the button. In deactivating the button, the user is not able to select the filtration option. Similar to above, the deactivation may include not allowing the button to register an input and/or deactivating the LED associated with the button.

At step 408, method 400 may include performing the selected washing operation according to a determined set of operating parameters. In detail, upon implementing the activated or deactivated state of the filtration selection button, the controller may finalize the operating parameters for the washing operation. The operating parameters may include cycles to be performed (e.g., rinse, agitation, drain, spin, etc.). Particularly, the operating parameters may include the filtration cycle. Upon determining that the filtration cycle is required, the controller may incorporate the filtration cycle within the operating parameters of the washing operation. As described above, the filtration cycle may be performed in the midst of the washing operation (e.g., together with a drain and resupply of the wash fluid). Moreover, the filtration cycle may be performed multiple times during the washing operation. For instance, the wash fluid may be supplied to the filter (e.g., filter 260) two or more times (e.g., during repeated drain and resupply cycles).

According to other embodiments, as described above, the filtration cycle is performed together with the drain cycle.

For instance, the controller may determine that the selected washing load requires a drain filtration. Additionally or alternatively, the appliance may incorporate a drain filter (e.g., filter housing 266) together with two drain lines. Thus, the filtration cycle may be performed as the wash fluid is being drained from the wash tub. In some embodiments, the controller may retrieve an algorithm including a standard set of operating parameters. For example, when the filtration option is either ineligible or not selected, the controller may incorporate the standard algorithm with the standard set of operating parameters.

FIG. 8 provides a flow chart illustrating a control method for a laundry treatment appliance. The control method 500 may start by determining whether the laundry treatment appliance is powered on for operation. Subsequently, the controller may determine that the course selection input has been input. As described above, the controller may determine that a course has been selected by a user, e.g., via the user input. The controller may then determine which washing operation has been selected. The controller may then determine whether the selected washing operation has a required filtration. If the selected washing course required filtration, the controller may disable the input selector that allows the user to deselect a filtration option. Additionally or alternatively, the controller may activate the LED associated with the input selector (e.g., to notify the user that filtration will be performed).

If the selected washing operation does not require filtration, the controller may determine if the selected washing operation is eligible for filtration. In detail, the controller determines if the selected washing course involves a laundry load which may be filtered during the washing operation. If the washing operation is not eligible for filtration, the controller may disable the input selector that allows the user to select a filtration option. As described above, this may be the same input selector that deselects the filtration option, or may be a separate input selector. The controller may then deactivate the LED associated with the input selector. If the selected washing operation is eligible for filtration, the controller enables the input selector to select and/or deselect the filtration option and activates the LED associated with the input selector. The controller may then initiate the corresponding algorithm including the filtration cycle or omitting the filtration cycle.

According to the disclosure, a laundry treatment appliance may manipulate a user interface thereof to allow or disallow a user from selecting certain options. A controller of the appliance may receive an input to perform a specific selected washing operation. The controller may determine whether a filtration cycle is required, optional, or ineligible for the selected washing operation. When the filtration cycle is required, the controller may deactivate a button on the user interface that allows a user to deselect the filtration cycle. When the filtration cycle is ineligible, the controller may deactivate a button on the user interface that allows a user to select the filtration cycle. The select button and the deselect button may be the same button. When the filtration cycle is eligible or optional, the controller may activate the button on the user interface, allowing a selection or deselection of the filtration cycle. The controller may then implement a control algorithm incorporating operating parameters commensurate with the washing cycle, including a selected or deselected filtration cycle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry treatment appliance defining a vertical direction, a lateral direction, and a transverse direction, the laundry treatment appliance comprising:

a cabinet forming a receiving space;

a user interface provided on the cabinet, the user interface comprising a selector input;

a tub provided within the receiving space;

a wash basket rotatably provided within the tub and configured to hold a laundry load and a wash fluid;

a filter in fluid communication with the tub, the filter comprising a coarse filter and a fine filter, the filter selectively filtering the wash fluid;

a first drain line fluidly connecting the tub with the filter;

a second drain line fluidly connected with the tub and an exterior of the tub, wherein the wash fluid is selectively urged through one of the first drain line through the filter or the second drain line bypassing the filter; and a controller provided within the cabinet and configured to perform a series of operations, the series of operations comprising:

receiving an input for a selected washing operation for the laundry load;

determining a filtration requirement of the wash fluid and the laundry load of the selected washing operation, the filtration requirement being based on a material composition of one or more items in the laundry load;

changing an activation state of the selector input in accordance with the determined filtration requirement, wherein changing the activation state of the selector input comprises deactivating the selector input on the user interface, the selector input comprising a button to deselect a filtration option, and wherein the selector input is deactivated in each of a required filtration cycle and a prohibited filtration cycle; and performing the selected washing operation according to a determined set of operating parameters.

2. The laundry treatment appliance of claim 1, wherein determining the filtration requirement of the selected washing operation comprises:

determining that the selected washing operation requires a filtration of the laundry load.

3. The laundry treatment appliance of claim 2, wherein the determined set of operating parameters comprises a filtration cycle, the filtration cycle comprising circulating the wash fluid from the tub through the filter.

4. The laundry treatment appliance of claim 1, wherein determining the filtration requirement of the selected washing operation comprises:

determining that the selected washing operation does not require a filtration of the laundry load, and wherein changing the activation state of the selector input comprises:

activating the selector input on the user interface, the selector input comprising a button to deselect a filtration option.

5. The laundry treatment appliance of claim 4, wherein the series of operations further comprises:

activating a light emitting diode (LED) to illuminate the selector input.

6. The laundry treatment appliance of claim 4, wherein the series of operations further comprises:

determining that the laundry load of the selected washing operation is ineligible for the filtration; and deactivating the selector input on the user interface.

7. The laundry treatment appliance of claim 1, further comprising:

a fluid recirculation system through which wash fluid from the tub is recirculated to the tub, wherein the filter is in fluid communication with the fluid recirculation system such that the wash fluid flows through the filter before being resupplied to the tub.

8. The laundry treatment appliance of claim 7, wherein the fluid recirculation system comprises:

a recirculation hose fluidly connected with the tub;

a recirculation pump provided on the recirculation hose, the recirculation pump configured to circulate the wash fluid through the recirculation hose; and a dispenser drawer fluidly connected with the recirculation hose, wherein the filter is provided within the dispenser drawer.

9. The laundry treatment appliance of claim 1, further comprising:

a filter housing fluidly connected with the first drain line, the filter being provided within the filter housing.

10. The laundry treatment appliance of claim 9, further comprising:

a drain pump fluidly connected with the first drain line and the second drain line, wherein the drain pump urges the wash fluid through the first drain line according to a first set of operating parameters and the drain pump urges the wash fluid through the second drain line according to a second set of operating parameters.

* * * * *